United States Patent [19]

Hugin et al.

[11] Patent Number: 4,822,961

[45] Date of Patent: Apr. 18, 1989

[54] SOFT BREAK SWITCH

[76] Inventors: Peter E. Hugin, 692 Distel Dr., Los Altos, Calif. 94022; Ted N. Tilman, 3538 Telegraph Dr., San Jose, Calif. 95132

[21] Appl. No.: 164,658

[22] Filed: Mar. 7, 1988

[51] Int. Cl.[4] ..... H01H 9/30; H01H 15/00

[52] U.S. Cl. ..... 200/16 R; 200/16 B; 200/16 D; 200/144 R; 200/144 AP; 338/176

[58] Field of Search ..... 200/16 R, 16 B, 16 E, 200/144 AP, 144 R; 338/49, 172, 173, 176–179, 198

[56] References Cited

U.S. PATENT DOCUMENTS 2,130,303 9/1938 Huss ..... 200/16 B X 2,136,612 11/1938 Dubuar ..... 200/16 B X

*Primary Examiner*—J. R. Scott

*Attorney, Agent, or Firm*—Rosenblum, Parish & Bacigalupi

[57] ABSTRACT

A soft break switch for forming a short circuit between two conductors while the switch is in a closed position, for forming an increasingly resistive circuit between the conductors while the switch is being moved to an open position, and for forming an open circuit between the conductors when the switch is in an open position. The resistive circuit enhances arc suppression.

13 Claims, 3 Drawing Sheets

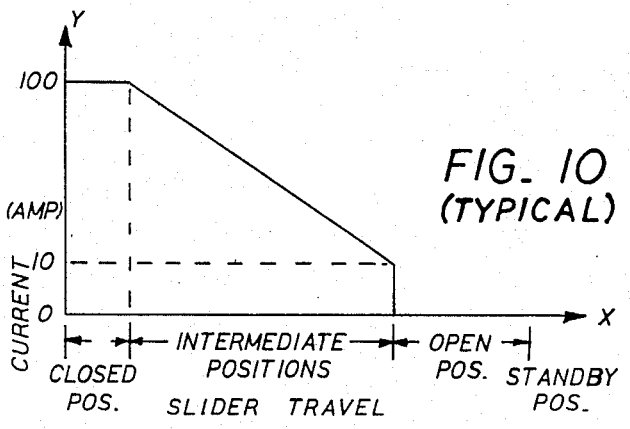
FIG. 10
(TYPICAL)
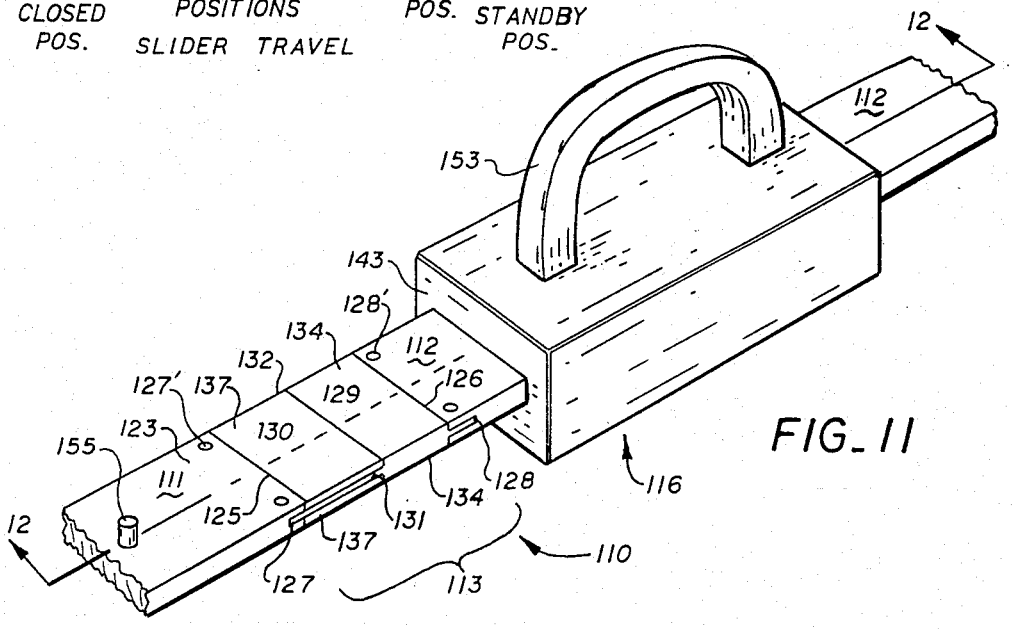
FIG. 11
FIG. 12
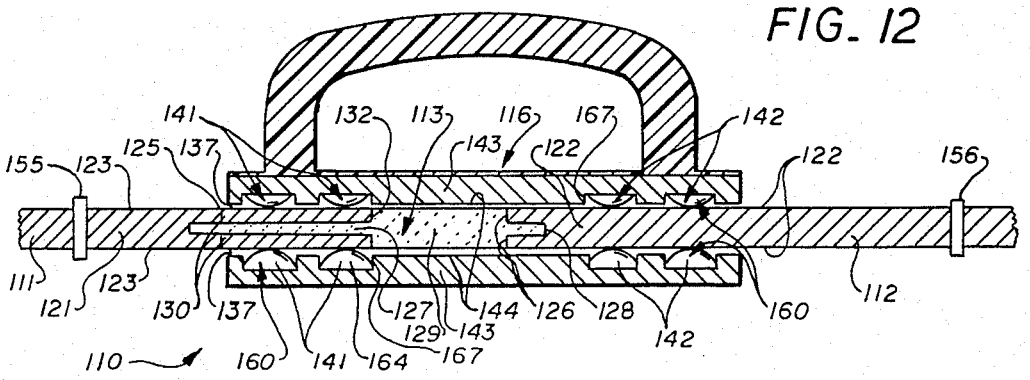

SOFT BREAK SWITCH

BACKGROUND OF THE INVENTION

1. Field of the Invention

The present invention relates generally to electrical current switches, and more particularly to a switch for gradually reducing a flow of current through the switch before disconnecting two conductors so as to avoid inducing a current arc across the switch when disconnecting the conductors.

2. Discussion of the Prior Art

Electrical current flowing through a conductor in a circuit including an inductive load such as a power supply transformer induces an electrical field which tends to maintain the flow of current through the conductor. The greater the current flow, the stronger the electrical field. When points such as switch contacts in the conductor are being disconnected, such an electrical field will briefly tend to induce a voltage surge causing an arc across the opening between the points being disconnected. Such current arcs can weld together switch contact points or damage other components in the circuit. This problem of arcing may be handled by deactivating all affected components before "powering down" the power supply in a circuit. Alternatively, current arcs may be handld by a surge suppressing device incorporated into a circuit. A variable resistance device (such as a rheostat) can be used in a circuit to gradually reduce the current flow and accompanying tendency to art. However, conventional variable resistances are deficient for this function because surge suppressing devices must be scaled to sizes capable of handling particular applications, and are often undesirably costly and inconvenient. Furthermore, conventional variable resistances would also require switches.

Thus, there is a need for a means to gradually reduce the flow of current between two conductors to reduce the induction of an electrical field which would tend to arc current across the opening between points in the two conductors being disconnected.

SUMMARY OF THE PRESENT INVENTION

It is therefore a primary objective of the present invention to provide a switch having means to gradually reduce the flow of current between two conductors during separation of the contacts to reduce the induction of an electrical field which would tend to arc current between points being disconnected in the two conductors.

Another objective is to provide a switch to conductively connect two conductors and to gradually decrease the conductivity of the connection while switching.

Still another objective is to provide a means to controllably decrease the conductivity of a switch connection which is simple, reliable, convenient and economical.

Briefly, the present invention achieves these and other objectives by providing a soft break electrical current switch in a preferred embodiment comprising first and second conductive end terminals which are mechanically connected by a coupling means including a resistor portion electrically connected to one of the conductors and including an insulator portion separating the resistor portion from the other of the conductors. The switch also includes a slider in which first and second contact means are held, carried and electrically connected by a conductive sleeve. The slider is moveable between a closed position where the first and second terminals are electrically connected by respective contact means through the conductive sleeve, moveable through intermediate positions where the first terminal is increasingly separated by the resistor portion from the first contact means, to an open position where the first terminal is electrically isolated by the insulator portion from the first contact means and thus isolated from the second terminal.

These and other objects of the present invention will become apparent to those of ordinary skill in the art upon reading the following detailed description of the preferred embodiments which are shown in the accompanying drawing figures.

BRIEF DESCRIPTION OF THE DRAWING

FIG. 10 is a graph showing the relationship of current through the switch versus the slider position;

FIG. 11 is an isometric view of a second embodiment of a switch according to the present invention; and FIG. 12 is a cross-section taken along the line 12—12 or the longitudinal axis of the embodiment of FIG. 11.

DETAILED DESCRIPTION OF THE PREFERRED EMBODIMENTS

Figure 1:
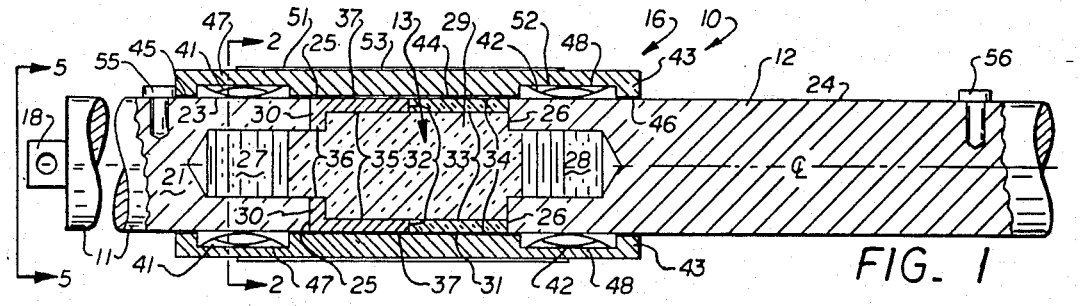
FIG. 1 is a cross-section along the longitudinal centerline axis through a switch according to the present invention in a closed position.

Referring to FIG. 1, the present invention provides a soft break switch 10 for alternately connecting and disconnecting a first conductive end terminal 11 and a second conductive end terminal 12. Switch 10 includes a coupling means 13 and a slider means 16.

Conductive end terminals 11 and 12 are typically made of copper and have end portions 21 and 22 with cylindrical outer surfaces 23 and 24 and with end surfaces 25 and 26, respectively. End terminals 11 and 12 have respective connector means, of which only left terminal connector 18 is shown, for connecting the terminals to external conductors (not shown). Terminal end portions 21 and 22 are spaced apart with their respective centerlines CL aligned on a common axis by coupling means 13. Coupling means 13 is preferably fixedly attached to terminal end surfaces 25 and 26 by threaded bolt portions 27 and 28 which project axially from opposite ends of coupling means 13 and are respectively received in complementary threaded holes in first and second terminal end surfaces 25 and 26. Coupling means 13 includes an insulator portion 29 and a resistor portion 30.

Insulator portion 29 is preferably made of epoxy glass with an outer surface 31 which is recessed inward from the peripheries of cylindrical outer surfaces 23 and 24, and which extends from the coupling midportion 32 towards, and is fixed attached to, the first terminal end surface 25. Insulator portion 29 is also fixedly attached to second terminal end surface 26. Insulator portion 29 preferably includes insulative spacing means 33 which is made of TEFLON® or other suitable material, and which surrounds surface 31 of insulator portion 29 and extends from the midportion 32 to the second tereminal 12 end surface 22. Spacing means 33 has a cylindrical outer surface 34 continuous with the outer surface 24 of the second terminal 12. Isulator portion 29 electrically isolates terminals 11 and 12 from each other.

Resistor portion 30 is preferably made of graphite or other high resistance material and has an inside surface 35 which surrounds insulator surface 31 between first terminal end surface 25 and the midportion 32 of coupling 13. Resistor portion 30 is preferably in a cup-like form with a lip 36 which is ohmically connected to the first terminal end surface 25 and which extends around part of insulator 29 between end surface 25 and insulator outer surface 31. Resistor portion 30 has a cylindrical outer surface 37 which is continuous with the first terminal's outer surface 23, and which extends from end surface 25 to the midportion 32 of coupling 13.

Slider means 16 is slideably disposed around the respective outer surfaces of terminal 11, terminal 12 and coupling means 13. Slider means 16 includes a left side contact 41 and a right side contact 42 which are interconnected by a conductive sleeve 43. Sleeve 43 is preferably made of copper and has cylindrical inner surfaces 44, 45 and 46 which form a loose sliding fit with outer surfaces 23, 24 or 37. Sleeve 43 also has inner surfaces 47 and 48 which form left and right annular recesses or gaps 51 and 52 adjacent corresponding outer surfaces for containing the contacts 41 and 42, respectively. The inner surfaces 47 and 48 compress contact means 41 and 42 against the outer surfaces 23, 24, and 37 to form good ohmic contacts and to hold slider means 16 in place along the length of the switch. Slider means 16, while in a "closed" position as shown in FIG. 1, forms a short circuit connection from first terminal 11 through first contact means 41, conductive sleeve 43 and second contact means 42 to second terminal 12. Slider 16 optionally includes a nonconductive handle sleeve 53, with a knurled or textured surface, surrounding conductive sleeve 43. Left travel stop pin 55 stops slider means 16 from traveling beyond the closed position to the left, while right travel stop pin 56 limits travel of slider means 16 beyond an open switch position as will be described below.

Figure 2:
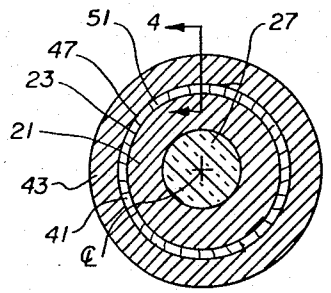
FIG. 2 is a cross-section along line 2—2 transverse to the longitudinal axis through the switch of FIG. 1.

FIG. 2 is a cross-section taken along line 2—2 transverse to the centerline CL of the FIG. 1 switch, and shows left contact means 41 compressed in gap 51 between sleeve 43 surface 47 and terminal end portion 21 surface 23, and also shows coupling means attachment bolt 27 threaded into, and rigidly attaching the coupling means to, the end portion 21 of the first terminal 11.

Figure 3:
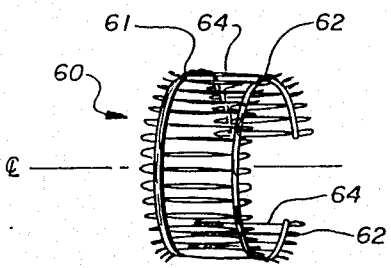
FIG. 3 is an isometric view of a contact band preferred for use as a contact means in the present invention.

FIG. 3 is an isometric view of a contact band 60 preferably used for left and right contact means 41 and 42. Contact band 60 includes parallel spaced side members 61 and 62 extending transverse to centerline CL, and also includes parallel spaced leaf spring members 64 which extend between side members 61 and 62, and which, before being compressed, are each at a greater angle to the plane of the two connected side members 61 and 62.

FIG. 1 is a cross-section taken along line 4—4 in FIG. 2 through contact means 41, and shows one of the leaf spring members 64 compressed within gap 51 between end portion 21 surface 23 and sleeve surface 47, with side members 61 and 62 preferably held by dove-tailed groove walls 67 between surfaces 44 and 45 of sleeve 43.

Figure 5:
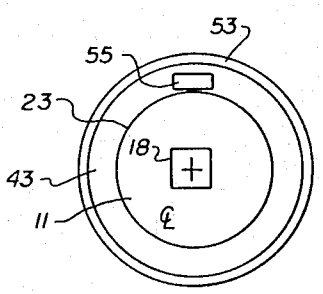
FIG. 5 is an end view along line 5—5 transverse to the longitudinal axis of the switch of FIG. 1.
Figure 4:
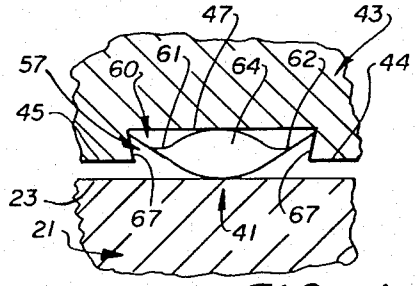
FIG. 4 is a cross-section along line 4—4 of FIG. 2 and showing a detail of a leaf spring in the preferred contact band.

FIG. 5 is an end view, taken along line 5—5 of FIG. 1 switch 10, showing connector means 18, left travel stop pin 55, handle sleeve 53, and conductive sleeve 43 disposed around outer surface 23 of terminal 11.

Figure 6:
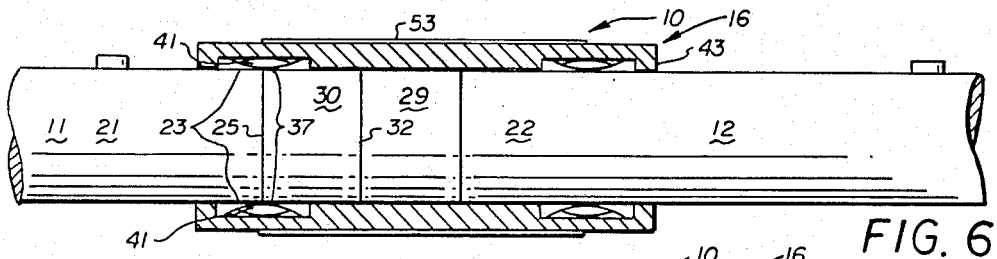
FIG. 6 shows a side view of the FIG. 1 switch and a cross-section through the slider means in an early intermediate position where the first contact engages more of the resistor portion.

FIG. 6 shows switch 10 with slider means 16 moved from the closed position of FIG. 1 to a beginning intermediate position where contact 41 engages less of the terminal surface 23 and engages more of the surface 37 of resistor portion 30.

Figure 7:
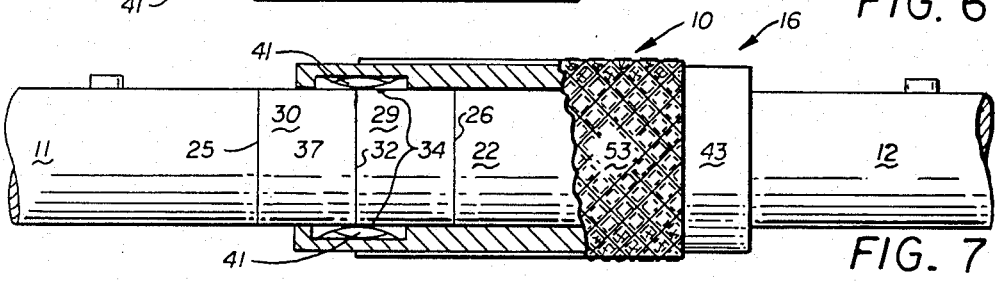
FIG. 7 shows the FIG. 1 switch with a cross-section through the slider means in a later intermediate position where the first contact engages less of the resistor portion.

FIG. 7 shows switch 10 with slider means 16 moved from the beginning intermediate position to an ending intermediate position where contact 41 engages less of the surface 37 of resistor portion 30 and engages more of surface 34 of insulator portion 29.

Figure 8:
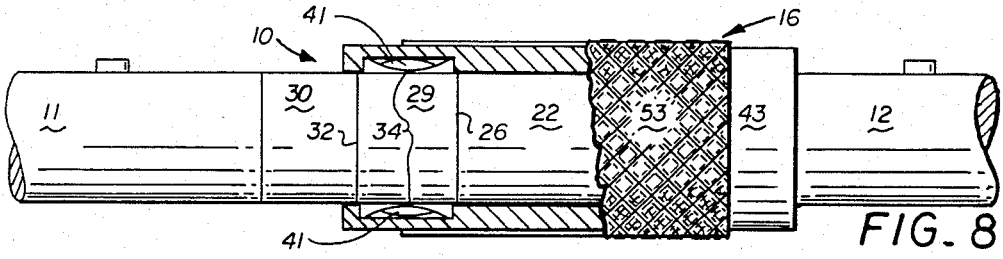
FIG. 8 shows the FIG. 1 switch with the slider means partially broken away in a second position where the first contact engages only the insulator portion.
Figure 9:
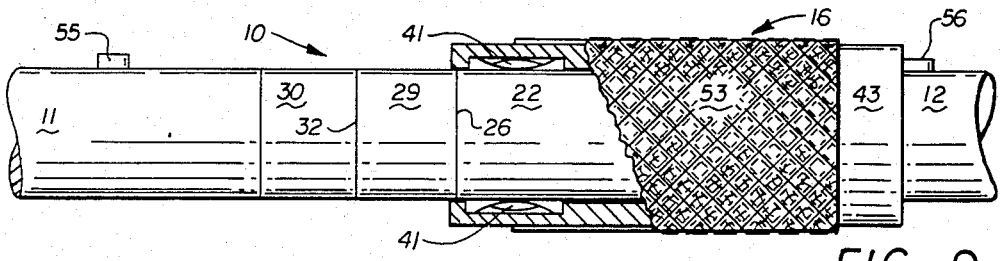
FIG. 9 shows the FIG. 1 switch with the slider means partially broken away in a third position where the first contact engages neither the first terminal nor the resistor portion nor the insulator portion.

FIG. 8 shows switch 10 with slider means 16 moved to an "open" position where contact 41 engages only surface 34 of insulator portion 29. FIG. 9 shows switch 10 with slider means 16 moved beyond the open position to a "standby" position where slider 16 travel is stopped by right travel stop pin 56, and where contact means 41 engages neither first terminal 11 nor resistor portion 30, and is separated from terminal 11 and resistor portion 30 by insulator portion 29.

In operation, as slider means 16 is moved from the closed position to the open position, switch 10 forms, between terminals 11 and 12, an electrical circuit exhibiting a resistance as shown in the FIG. 10 graph of switch 10 current on the Y axis vs. slider 16 position on the X axis. When slider 16 is in the closed position it forms a short circuit between terminals 11 and 12 and, for example, under a 0.02 volt or slightly higher bias conducts a current of 100 amps. As slider 16 is moved through the intermediate positions it forms an increasingly resistive or decreasingly conductive circuit through resistor portion 30 until the current through switch 10 is reduced typically to 10 amps when the first contact means is disengaged from the resistor portion as slider 16 arrives in the open position. The first and second terminals remain electrically isolated by insulator portion 29 as the slider is moved beyond the open position to a standby position, as indicated in FIG. 9, where slider 16 travel is stopped by right travel stop pin 56. Although FIG. 10 suggests operation of the present invention in a 100 ampere application, it should be understood that the switch can also handle substantially higher currents.

FIG. 11 shows the invention in a second embodiment as a switch 110 adapted for use connecting and disconnecting conductive end terminals 111 and 112 with rectangular end portions 121 and 122 and a rectangular coupling means 113. The above-described first embodiment elements generally correspond to elements numbered 100 higher in this second embodiment. Switch 110 is shown in FIG. 11 in a standby position corresponding to the standby position of switch 10. Switch 110 includes a coupling means 113 and a slider means 116. Conductive end terminals 111 and 112 have outer surfaces 123 and 124 with end surfaces 125 and 126, respectively. Coupling means 113 spaces apart, and is preferably fixedly attached to, terminal end portions 121 and 122 by screws, rivets or other suitable fasteners 127' and 128' disposed through left and right projections 127 and 128, respectively. Coupling means 113 icludes an insulator portion 129 and a resistor portion 130. Insulator portion 129 has outer surfaces 134 continuous with the outer surfaces 137 of resistor portion 130 and surfaces 124 of terminal 122.

Resistor portion 130 is preferably made of graphite, or other suitable highly resistive material, and has an outer surface 137 which is continuous with the first terminals surface 123, and which extends from end surface 125 to the midportion 132 of coupling 113.

Slider means 116 is slidably disposed around the respective outer surfaces of terminal 111, terminal 112 and coupling means 113. Slider means 116 includes a left side contact means 141, which in this embodiment includes a pair of contact bands 160 above, and a pair of contact bands 160 below, the portions to be engaged. Similarly, right side contact means 142 includes a pair of contact bands 160 above and another pair of contact bands 160 below the portions to be engaged.

FIG. 12 shows switch 110 in an intermediate position corresponding to the intermediate positions of switch 10 described above. As slider means 116 is moved from a closed position abutting left travel stop pin 155 across resistor portion 130, switch 110 forms between terminals 111 and 112 and electrical circuit which likewise exhibits a resistance as shown in the FIG. 10 graph. Switch 110 though may be used for higher current applications wherein rectangular buses are used instead of flexible cables.

Although the present invention has been described in terms of two preferred embodiments, it will be appreciated by those skilled in the art that these embodiments may be modified without departing from the essence of the invention. It is therefor intended that the following claims will be interpreted as covering any modifications falling within the true scope and spirit of the invention.

We claim:

1. A soft break electrical current switch comprising: first and second conductive end terminals; coupling means mechanically connecting said first terminal to said second terminal and including a resistor portion electrically connected to said first terminal, and an insulator portion electrically separating said resistor portion and said first terminal from said second terminal; and slider means moveable between a closed position and an open position and including first contact means for engaging said first terminal when said slider means is in said closed position, for moving across and enagaging said resistor portion as said slider means is moved between said closed and open positions, second contact means for continuously engaging said second terminal, and a conductive sleeve for carrying and electrically interconnecting said first and second contact means;

whereby said conductive end terminals are electrically interconnected by a short circuit through said slider means when said slider means is in said closed position, said terminals are electrically connected by an increasingly resistive circuit through said resistor portion and said slider means as said slider means is moved from said closed position toward said open position, and said terminals are electrically isolated by said insulator portion when said slider means is in said open position.

2. A switch as in claim 1 wherein:

said terminals each include an axially aligned elongated end portion having a cylindrical outer surface and an end surface;

said coupling means is fixedly attached to each of said end portions;

said resistor portion is ohmically connected to the end portion of said first terminal and has a cylindrical outer surface continuous with said outer surface of said first terminal and extending from the end surface of said first terminal to the midportion of said coupling means;

said insulator portion extends at least from said midportion to the end surface of said second terminal;

said slider means is disposed around the outer surface of at least said second terminal;

said conductive sleeve has a cylindrical inner surface forming a loose sliding fit around said outer surfaces, and has other inner surfaces forming first and second internal annular recesses for receiving said first and second contact means;

said contact means are disposed within respective ones of said annular recesses; and wherein as said slider means is moved from said closed position across said resistor portion to said open position, said slider means passes through intermediate positions where said first contact means decreasingly engages said first terminal and increasingly engages said resistor portion, and then decreasingly engages said resistor portion and increasingly engages said insulator portion, and wherein said slider means is reciprocally moveable beyond said open position to a standby position where said first contact means engages said second conductive end terminal and engages neither said first terminal nor said resistor portion nor said insulator portion.

3. A switch as in claim 2 wherein:

said insulator portion has an outer surface which is recessed inward from the other said outer surfaces and which extends from said midportion towards the end surface of said first terminal, and is fixedly attached to each of said end surfaces; and said resistor portion has an inner surface contiguous with said outer surface of said insulator portion.

4. A switch as in claim 3 further comprising travel stop pins protruding from each of said terminal outer surfaces at spaced apart locations to limit travel of said slider means along said outer surfaces.

5. A switch as in claim 3 wherein said slider means further comprises a nonconductive handle sleeve disposed on the outside of said conductive sleeve.

6. A switch as in claim 3 wherein said insulator portion comprises insulative spacing means disposed around said outer surface of said insulator portion and which extends between, and has a cylindrical outer surface continuous with, said outer surfaces of said resistor portion and of said second terminal.

7. A switch as in claim 4 wherein said insulative spacing means comprises TEFLON®.

8. A switch as in claim 3 wherein said end portions, said coupling means, and said slider means are circular in cross sections tranverse to the longitudinal axis of said end portions.

9. A switch as in claim 8 wherein said resistor portion has a lip portion which extends inward further than said inner surface of said resistor portion and which is in ohmic contact with said first terminal end surface.

10. A switch as in claim 8 wherein said insulator portion includes axial projections for attaching said coupling means to each of said terminal end portions.

11. A switch as in claim 3 wherein said end portions, said coupling means, and said slider means are rectangular in cross-sections transverse to the longitudinal axis of said end portions.

12. A switch as in claim 11 wherein said insulator portion includes projections from each end of said coupling means, and wherein said terminal end surfaces have openings complementary to said projections, and said projections are secured within said openings by fasteners extending through respective ones of said terminals and ones of said projections.

13. A soft break electrical current switch comprising:

first and second conductive end terminals each including an elongated end portion having a longitudinal centerline, a cylindrical outer surface, and an end surface;

coupling means fixedly attached to each of said end surfaces and aligning said centerlines on a common axis, and including a resistor portion ohmically connected to said end surface of a first one of said terminals and having a cylindrical outer surface continuous with said outer surface of said first terminal and extending from said first end surface to the midportion of said coupling means, and an insulator portion extending from said midportion to the second of said end surfaces; and slider means disposed around the outer surface of at least said second terminal and including a conductive sleeve having a first cylindrical inner surface forming a loose sliding fit around said at least one outer surface, and having second inner surfaces, recessed outward from said first inner surface and forming first and second annular recesses around said at least one outer surface, and first and second contact means disposed within respective ones of said annular recesses and electrically interconnected by said sleeve, said first contact means being compressed between one of said second inner surfaces and one of said outer surfaces, and said second contact means being compressed between another of said second inner surfaces and the outer surface of said second terminal;

said slider means being reciprocally slideable along said outer surfaces from a closed position where said first contact means engages the outer surface of said first terminal, through intermediate positions where said first contact means decreasingly engages said first terminal and increasingly engages said resistor portion, and then decreasingly engages said resistor portion and increasingly engages said insulator portion, to an open position where said first contact means engages neither said first terminal nor said resistor portion.

* * * * *